US007594883B1

(12) United States Patent
Eaddy

(10) Patent No.: US 7,594,883 B1
(45) Date of Patent: Sep. 29, 2009

(54) FABRIC GIFT BAG

(75) Inventor: Pamela K. Eaddy, Sanford, NC (US)

(73) Assignee: Rhonda G. Harrington, Sanford, NC (US)

( * ) Notice: Subject to any disclaimer, the term of this patent is extended or adjusted under 35 U.S.C. 154(b) by 578 days.

(21) Appl. No.: 11/242,201

(22) Filed: Oct. 3, 2005

(51) Int. Cl.

| | |
|---|---|
| ***B31B 1/60*** | (2006.01) |
| ***B31B 1/00*** | (2006.01) |
| ***B31B 1/90*** | (2006.01) |
| ***B31B 39/00*** | (2006.01) |
| ***B31B 1/14*** | (2006.01) |

(52) U.S. Cl. ..... 493/210; 493/186; 493/214; 493/217; 493/223; 493/225

(58) Field of Classification Search ..... 383/109, 383/4, 61.1, 61.4, 105, 127, 907, 71, 75, 383/76, 111, 117; 150/127, 129, 154, 150, 150/103; 206/37, 527, 525.1; 428/98; 229/800, 229/930, 87.19; 220/62.21, 62.14, 677; 493/162, 493/189, 199, 200, 254, 114, 186, 210, 214, 493/217, 223, 225

See application file for complete search history.

(56) References Cited

U.S. PATENT DOCUMENTS

| | | | | | |
|---|---|---|---|---|---|
| 213,580 | A | * | 3/1879 | Lindheim | 383/4 |
| 735,560 | A | * | 8/1903 | Muller | 383/76 |
| 822,155 | A | * | 5/1906 | Sano | 383/109 |
| 2,043,782 | A | * | 6/1936 | Sprosty | 383/109 |
| 2,182,879 | A | * | 12/1939 | Rinehart | 150/129 |
| 2,529,578 | A | * | 11/1950 | Thompson | 239/55 |
| 2,530,746 | A | * | 11/1950 | Wetherby | 15/104.94 |
| 2,580,796 | A | * | 1/1952 | Kleiss et al. | 383/6 |
| 2,721,691 | A | * | 10/1955 | Makrauer | 383/110 |
| 2,870,811 | A | * | 1/1959 | Harrison | 383/109 |
| 3,044,517 | A | * | 7/1962 | Levi | 383/109 |
| 3,826,296 | A | * | 7/1974 | Morris | 383/109 |
| 4,185,673 | A | * | 1/1980 | Daniello | 383/14 |
| 4,273,174 | A | * | 6/1981 | Potter | 383/8 |
| 4,807,299 | A | * | 2/1989 | Nattrass et al. | 383/109 |
| 5,031,759 | A | * | 7/1991 | Ogilvie | 206/77.1 |
| D350,475 | S | * | 9/1994 | Cirelli | D9/670 |
| 5,857,794 | A | * | 1/1999 | Chien | 383/117 |
| D441,279 | S | * | 5/2001 | Remar | D9/706 |
| 2005/0161352 | A1 | * | 7/2005 | Huddleston | 206/320 |
| 2007/0179458 | A1 | * | 8/2007 | Leroy et al. | 604/317 |
| 2008/0050054 | A1 | * | 2/2008 | Koopah | 383/109 |
| 2009/0097784 | A1 | * | 4/2009 | Curren | 383/71 |

* cited by examiner

*Primary Examiner*—Jes F Pascua
(74) *Attorney, Agent, or Firm*—Coats & Bennet, P.L.L.C.

(57) ABSTRACT

A fabric gift bag is constructed from elongated fabric made up of two panels that are matching and which are secured by a perimeter seam. This multi-panel composite includes first and second end portions and an intermediate portion. The first end portion is narrower than the second end portion and the intermediate portion is wider than the first and second end portions. The multi-panel composite is reversed to form a modified composite panel. The second end portion of the composite is opened by spreading the two panels and the first end portion is inserted into the second end portion and secured to form the fabric gift bag with an open top and a surrounding wall structure made up of two panel portions disposed in side-by-side relationship. A retainer is extended around an intermediate portion of the fabric gift bag causing an upper portion of the formed bag to flare outwardly.

7 Claims, 4 Drawing Sheets

FABRIC GIFT BAG

FIELD OF THE INVENTION

The present invention relates to gift bags, and more particularly to a fabric gift bag having an open top.

BACKGROUND OF THE INVENTION

Traditional gifts have, over the years, been presented in the form of packages or boxes having an external gift wrapping and a bow placed on the wrapping, or one or more ribbons extending around the wrapping and in some cases formed into a bow. These exterior wrappings and the placement of bows and ribbon is done by hand. Some individuals display more talent and ability at wrapping gift packages than others. While the end product is often attractive, exciting and pleasing in appearance, whether the gift was wrapped by an experienced and proficient individual or not, a great deal of time and labor is often expended.

In recent years we have seen the emergence of gift bags. Gift bags are sold in gift stores, retail shops of all types, and for the most part are constructed of paper that have a pleasing, colorful and sometimes exciting design formed about the exterior thereof. These paper gift bags are relatively inexpensive and easy to use. By utilizing such gift bags, one avoids the time consuming, and even sometimes, frustrating experience of having to wrap a gift for a loved one, friend, or other person.

While conventional gift bags have met with great success over the years, they are not appropriate for all occasions. Occasionally there is that special gift such as a diamond ring or other piece of jewelry that demands a more eloquent presentation. When these special occasions arise and an extraordinary or special gift is to be made, conventional paper gift bags will not suffice and the individual is again left with the challenging chore of hand wrapping a gift.

Therefore, there is and continues to be a need for a production type gift bag that is eloquent, pleasing, exciting, and which is appropriate for special or extraordinary gifts.

SUMMARY OF THE INVENTION

The present invention entails a fabric gift bag made of an elongated multi-panel composite wherein one end portion of the composite is opened by separating portions of the panels and inserting the other end portion therein. This forms a fabric gift bag having an open top.

In one embodiment of the fabric gift bag, the fabric gift bag when formed includes an upper portion and a lower portion and the upper portion flares outwardly with respect to the lower portion.

In still another embodiment of the present invention the fabric gift bag is provided with a retainer that extends around an intermediate portion of the fabric gift bag and effectively exaggerates the taper of the upper end portion.

The present invention also entails a method of forming a fabric gift bag. The method entails cutting two substantially matching fabric panels from one or more fabric sources. Each fabric panel is configured such that the panels include a first end portion, a second end portion, and an intermediate portion and wherein the panels are sized such that the first end portion is narrower than the second end portion and the intermediate portion is wider than the first and second end portions. Next, the method entails securing the two panels together by a perimeter seam. Thereafter the first end portion is inserted into the second end portion to form a fabric gift bag having a bottom, an open top and a surrounding sidewall structure comprised of the two panels.

Other objects and advantages of the present invention will become apparent and obvious from a study of the following description and the accompanying drawings which are merely illustrative of such invention.

DESCRIPTION OF EXEMPLARY EMBODIMENT

Figure 1:
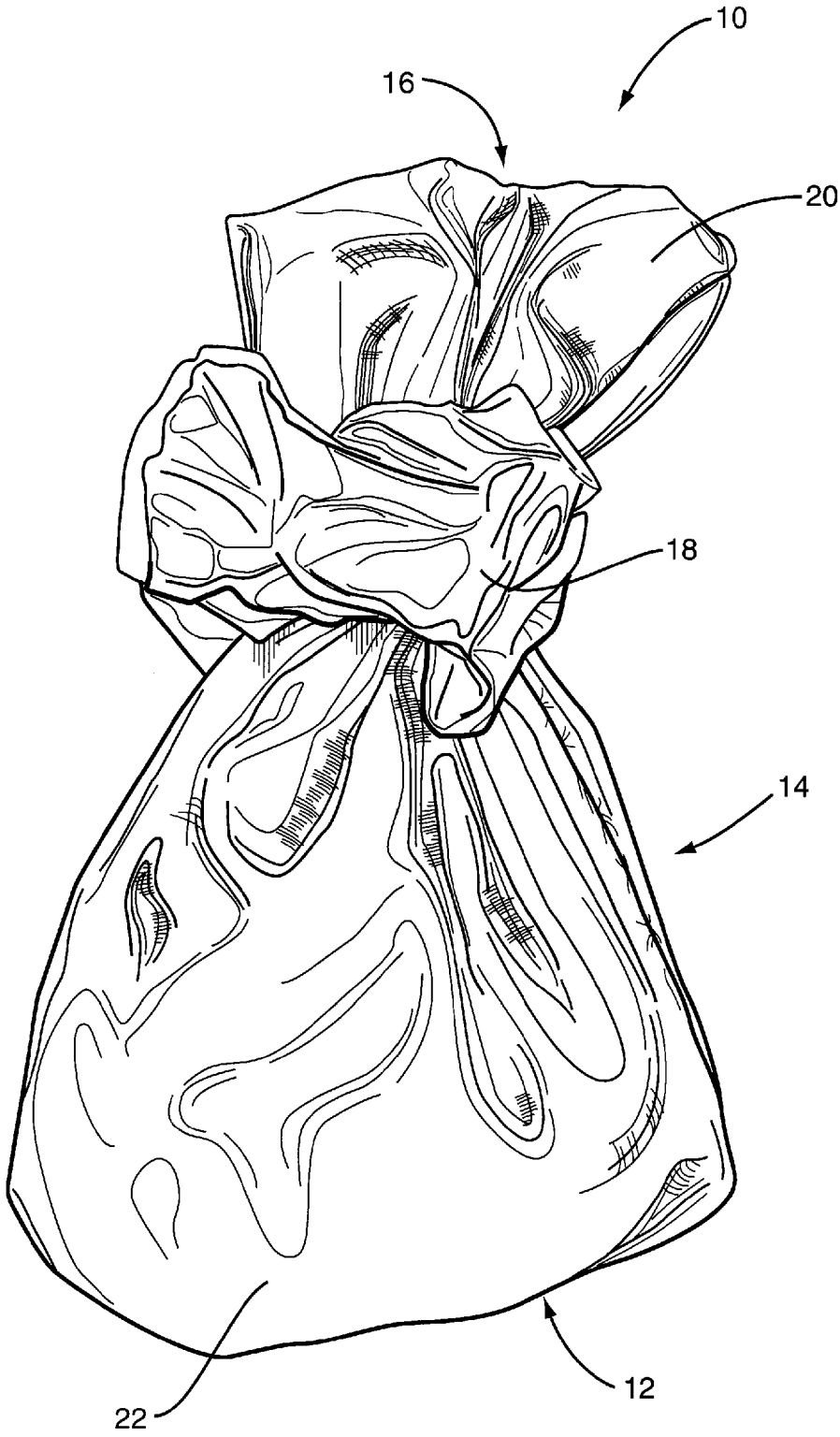
FIG. 1 is a perspective view of the fabric gift bag of the present invention.
Figure 4:
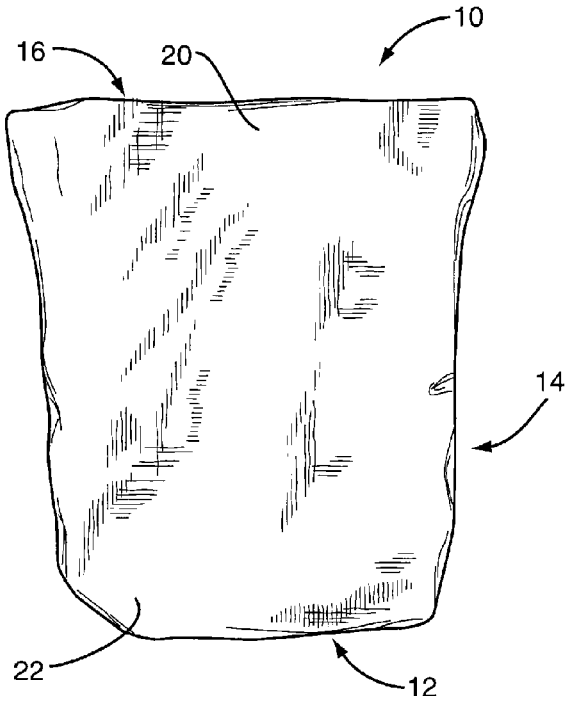
FIG. 4 is a side elevational view of the fabric gift bag without the retainer.

With further reference to the drawings, a fabric gift bag is shown therein and indicated generally by the numeral 10. As seen in FIGS. 1 and 4, the fabric gift bag 10 includes a bottom indicated generally by the numeral 12, and a pliable sidewall indicated generally by the numeral 14. An open top, indicated generally by the numeral 16, is formed at the top of the gift bag. A retainer 18 extends around an intermediate portion of the gift bag, and as will be discussed subsequently herein, tends to exaggerate the flared nature of an upper portion 20 of the bag. When the retainer 18 is removed from the gift bag 10 and placed on a flat surface, as shown in FIG. 4, the upper portion 20 tends to flare outwardly. Retainer 18 may assume various forms. In some cases it can comprise a decorative ribbon or a decorative ribbon that includes an internal elastic member. Disposed below the retainer 18 is an area of the bag that is referred to as the lower portion 22.

Figure 2:
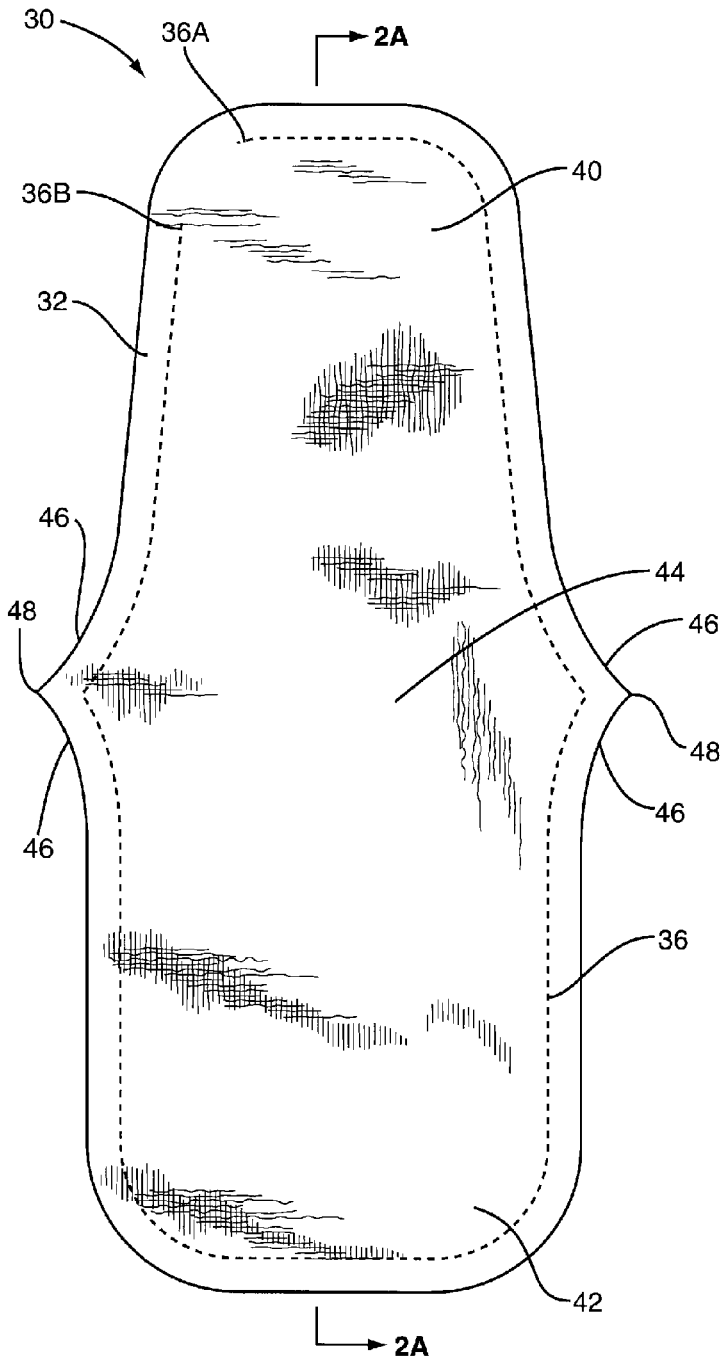
FIG. 2 illustrates a multi-panel composite that forms a part of the fabric gift bag.
Figure 3:
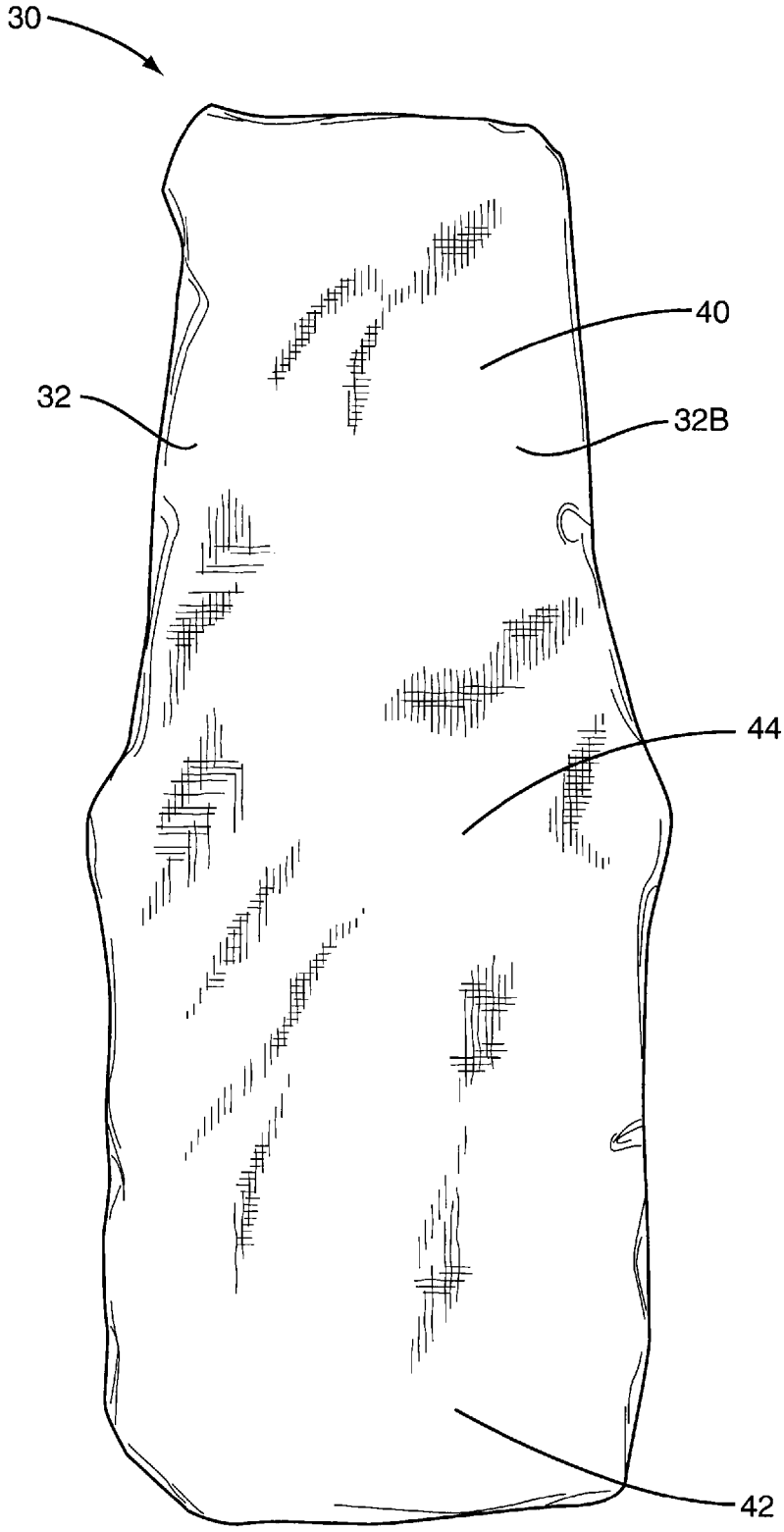
FIG. 3 is a view similar to FIG. 2 but with the multi-panel composite being reversed.

Turning to FIGS. 2 and 3, it is seen that the fabric gift bag is constructed or formed from an elongated multi-panel fabric composite indicated generally by the numeral 30. This multi-panel composite is sometimes referred to as a base. By multi-panel, it is meant that in one embodiment the composite or base 30 includes two fabric panels, panels 32 and 34. The term fabric, as used herein, means a cloth such as that produced by knitting or weaving, and further includes materials such as leather, vinyl and synthetics typically used to make handbags, apparel, and other bags for carrying personals. The two fabric panels 32 and 34 are generally of the same shape and size. That is, they are congruent. A perimeter seam 36 extends substantially around the perimeter of the two panels 32 and 34 so as to secure the panels together. Note that perimeter seam 36 is slightly indented from the outer edges of the respective fabric panels 32 and 34. For purposes of reference, the multi-panel composite 30 shown in FIGS. 2 and 3 is said to include a first end portion 40, a second end portion 42 and an intermediate portion 44. In the embodiment illustrated herein, the first end portion 40 is at least slightly narrower than the second end portion 44 when the composite 30 is laid flat on a surface. See FIG. 2. Further, the intermediate portion 44 is slightly wider than the first end portion 40. In some cases, the intermediate portion 44 may be slightly wider than the second end portion 42.

As noted above, each fabric panel 32 and 34 includes a surrounding edge. The intermediate portion 44 includes opposing edges that comprise curve segments 46. In this embodiment the curved segments 46 extend outwardly and form a point 48.

Figure 2A:
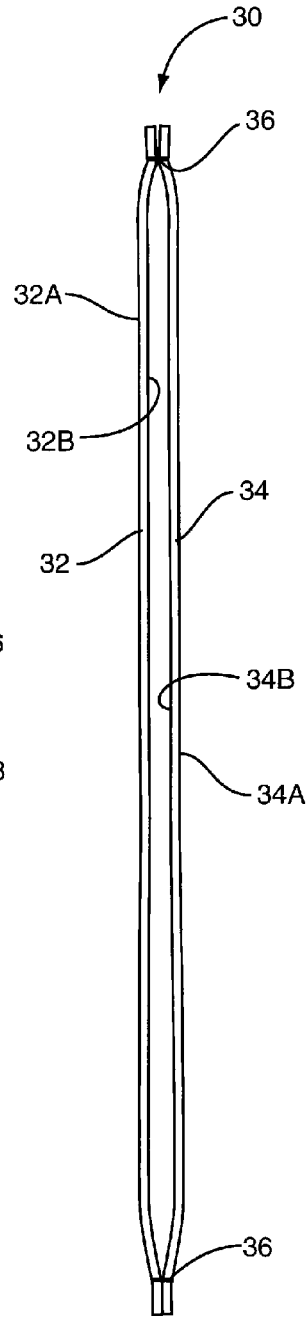
FIG. 2A is a sectional view taken through the lines 2*a*-2*a* of FIG. 2.

Each of the panels 32 and 34 has outer and inner sides. In FIGS. 2 and 2A the panel 32 includes an outer side 32A and an inner side 32B. The other panel 34 includes an outer side 34A and an inner side 34B. In the configuration shown in FIGS. 2 and 2A, the outer sides 32A and 34A may be unfinished. The inner sides 32B and 34B would preferably be finished. Note in FIG. 2 where the perimeter seam 36 does not extend entirely around the fabric panels 32 and 34. The perimeter seam is terminated about an area such that there is a small opening formed between two seam points 36A and 36B shown in FIG. 2. The composite panel or base 30 shown in FIG. 2 is reversed by pulling portions of the panels through the opening formed between seam points 36A and 36B. Other ways of reversing the composite panel 30 can be employed. But in any event, this reversal results in turning the composite right sides outwardly. That is, the inner sides 32B and 34B of the composite as shown in FIG. 2 are caused to form the outside of the composite as shown in FIG. 3. Now the former inner sides 32B and 34B become the outer sides of the composite shown in FIG. 3. The multi-panel composite 30 shown in FIG. 3 is sometimes referred to as a modified base.

To form or finish the gift bag 10, the second end portion 42 shown in FIG. 3 is somewhat larger in width than the first end portion 40. End portion 42 is open by pulling portions of the panels apart. Once opened, the first end portion 40 is pushed down or inserted into the second end portion 42. This forms the configuration shown in FIGS. 4 and 6. By inserting or pushing the first end portion 40 into the second end portion 42 a surrounding pliable panel wall structure is formed where the wall is generally two panels thick with the panel portions disposed in side-by-side relationship. The first end portion 40 can be stitched, or otherwise tacked or secured, to the lower portion 42.

Figure 6:
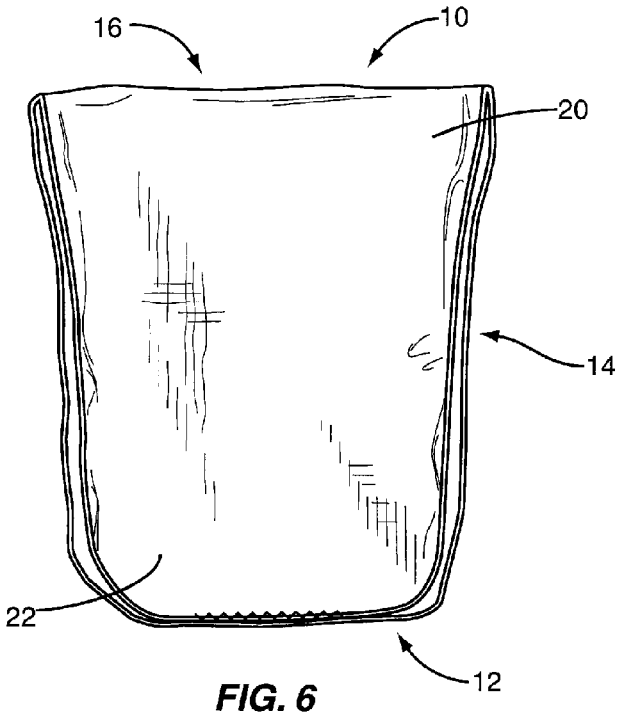
FIG. 6 is a sectional view of the fabric gift bag particularly illustrating the sidewall structure thereof.

Once the first end portion 40 has been inserted into the second end portion 42, an open top 16 is formed. The open top 16 extends around an opening and the insertion of the first end portion 40 into the second end portion 42 causes a top curl portion to form. This is illustrated in FIG. 6.

Figure 5:
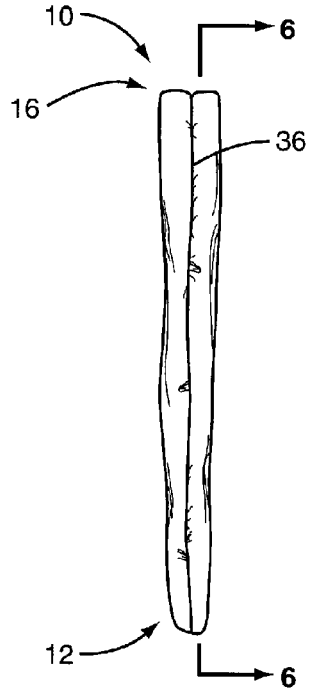
FIG. 5 is a side elevational view of the fabric gift bag as shown in FIG. 4.

The perimeter seam 36 shown in FIG. 2 forms a pair of exterior seams along opposite sides of the gift bag 10. Because the composite 30 has been reversed from the configuration shown in FIG. 2, it follows that the seam 36 formed in the finished bag 10 is indented at least slightly from outer adjacent portions of the respective panel. See FIG. 5.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

The invention claimed is:

1. A method of forming a fabric gift bag, comprising:

a. cutting two substantially matching fabric panels from one or more fabric sources;

b. configuring each fabric panel such that each fabric panel includes a first end portion, a second end portion and an intermediate portion, and sizing the respective panels such that the first end portion is narrower than the second end portion and the intermediate portion is wider than either the first and second end portions;

c. securing the two fabric panels together by a perimeter seam to form a composite panel comprising the two substantially matching fabric panels where the composite panel includes a first end portion, a second end portion, and an intermediate portion;

d. inserting the first end portion of the composite panel into the second end portion of the composite panel to form a fabric gift bag having a bottom, an open top, and a surrounding sidewall structure comprised of the two panels being disposed in back to back relationship and folded to form the open top;

e. providing a retainer for encircling an intermediate portion of the formed gift bag; and f. wherein the panels are configured such that when the first end portion of the composite panel is inserted into the second end portion of the composite panel that the formed fabric gift bag includes an upper portion and a lower portion wherein the upper portion of the formed gift bag is tapered outwardly with respect to the bottom portion.

2. The method of claim 1 wherein when the two fabric panels are secured together by a perimeter seam and when laid on a surface the two fabric panels lay substantially flat; and wherein when the two panels are secured together by the perimeter seam the composite panel is formed with each panel of the composite having an outer and an inner side; wherein the method entails reversing the composite panel before the first end portion is inserted into the second end portion.

3. The method of claim 2 wherein the perimeter seam in the formed fabric gift bag is indented with respect to adjacent portions of the respective panels.

4. The method of claim 2 including terminating the perimeter seam at two points so as to leave an opening between the two points of the perimeter seam such that access can be gained to an interior area of the composite panel; and turning the composite panel inside outwards by pulling the inner side of each panel of the composite panel through the opening formed between the two points.

5. The method of claim 4 wherein the perimeter seam in the formed fabric gift bag is indented with respect to adjacent portions of the respective fabric panels; the method further including forming a rolled upper edge in the fabric gift bag by pushing the first end portion of the composite panel downwardly into an open area defined between portions of the second end portion of the composite panel.

6. The method of claim 3 including forming a rolled upper edge that forms the top opening of the fabric gift bag and wherein the rolled edge is formed by pushing the first end portion of the composite panel downwardly into an open area defined between portions of the panel that form the second end portion of the composite panel.

7. The method of claim 1 including securing together the first end portion of the composite panel and the second end portion of the composite panel.

* * * * *

UNITED STATES PATENT AND TRADEMARK OFFICE

CERTIFICATE OF CORRECTION

PATENT NO. : 7,594,883 B1
APPLICATION NO. : 11/242201
DATED : September 29, 2009
INVENTOR(S) : Pamela K. Eaddy It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 939 days.

Signed and Sealed this

Twenty-eighth Day of September, 2010

David J. Kappos

David J. Kappos
*Director of the United States Patent and Trademark Office*